United States Patent [19]

Jeffrey et al.

[11] 4,318,755

[45] Mar. 9, 1982

[54] ALUMINUM ALLOY CAN STOCK AND METHOD OF MAKING SAME

[75] Inventors: Paul W. Jeffrey, Kingston, Canada; John C. Blade, Banbury, England

[73] Assignee: Alcan Research and Development Limited, Montreal, Canada

[21] Appl. No.: 211,644

[22] Filed: Dec. 1, 1980

[51] Int. Cl.[3] ..... C22F 1/04

[52] U.S. Cl. ..... 148/11.5 A; 148/32

[58] Field of Search ..... 148/11.5 A, 32, 2; 75/147, 142, 148

[56] References Cited

U.S. PATENT DOCUMENTS

| | | | |
|---|---|---|---|
| 3,787,248 | 1/1974 | Setzer et al. | 148/11.5 A |
| 3,802,931 | 4/1974 | Bylund | 148/11.5 A |
| 4,111,721 | 9/1978 | Hitchler et al. | 148/11.5 A |
| 4,235,646 | 11/1980 | Neufeld et al. | 148/2 |
| 4,238,248 | 12/1980 | Gyöngyös et al. | 148/2 |
| 4,260,419 | 4/1981 | Robertson | 75/142 |
| 4,269,632 | 5/1981 | Robertson et al. | 148/2 |

FOREIGN PATENT DOCUMENTS

| | | | |
|---|---|---|---|
| 51-4010 | 1/1976 | Japan | 75/142 |
| 51-73912 | 6/1976 | Japan | 75/142 |
| 52-73112 | 6/1977 | Japan | 148/11.5 A |
| 2027744 | 2/1980 | United Kingdom . | |

*Primary Examiner*—Peter K. Skiff

*Attorney, Agent, or Firm*—Cooper, Dunham, Clark, Griffin & Moran

[57] ABSTRACT

Aluminum alloy sheet at an intermediate temper and directly formable by drawing and ironing into a one-piece can body, containing 0.45–0.8% Mn and 1.5–2.2% Mg, with the following properties: ultimate tensile strength, at least about 38 k.p.s.i.; yield strength, at least about 35 k.p.s.i.; elongation, at least about 1%; earing, not more than about 4%.

7 Claims, No Drawings

ALUMINUM ALLOY CAN STOCK AND METHOD OF MAKING SAME

BACKGROUND OF THE INVENTION

This invention relates to aluminum alloy can stock, and more particularly to aluminum alloy sheet for forming one-piece drawn and ironed can bodies, as well as to a process for making can bodies from such sheet and to the product of that process.

Present-day metal cans as used for beverages such as soft drinks, beer and the like are commonly constituted of a seamless one-piece body (which includes the bottom end and cylindrical side wall of the can) and a top end bearing a ring or other opening device. The body is produced from a blank of cold-rolled aluminum alloy sheet (having a gauge, for example, of about 0.014 inch) by a now-conventional forming technique known as drawing and ironing, which involves drawing the blank into a cup and then passing it through a succession of dies to achieve the desired elongated cylindrical body configuration, with a side wall of reduced thickness relative to the bottom end. The top end is separately produced from another sheet aluminum alloy blank, by different but also conventional forming operations, and is secured around its circumference to the top edge of the side wall of the body to provide a complete can.

The severity of the forming procedure employed in producing a drawn-and-ironed can body as described above, and in particular the reduction in thickness of the can side wall (which must nevertheless be able to withstand the internal and external forces exerted on it in use), as well as the fact that the formed can is usually lacquered in an operation necessitating a strength-reducing exposure to heat, require a special combination of strength, formability, and tool wear properties in the alloy sheet from which the can body is made. Significant among these properties are ultimate tensile strength, yield strength, elongation, and earing. Attainment of the requisite combination of properties is dependent on alloy composition and on the processing conditions used to produce the sheet. At present, a preferred sheet for can body blanks is constituted of the alloy having the Aluminum Association (AA) designation 3004, and is produced from conventionally direct-chill-cast ingot up to 24 inches thick by scalping and homogenizing the ingot, and successively hot rolling and cold rolling to the desired final gauge. Often an anneal treatment is used between the hot and cold rolling operations, with the annealing gauge so selected that the amount of cold reduction to final gauge after annealing is about 85%, thereby to provide can body blanks in H19 (extra hard) temper. On the other hand, it is at present preferred to use a different alloy—AA 5082 or AA 5182—for the top end of the can. Compositions of the three aforementioned alloys are given in the following table:

| | Range or Maximum (%) | | |
|---|---|---|---|
| | AA 3004 | AA 5082 | AA 5182 |
| Si | 0.30 | 0.20 | 0.20 |
| Fe | 0.7 | 0.35 | 0.35 |
| Cu | 0.25 | 0.15 | 0.15 |
| Mn | 1.0–1.5 | 0.15 | 0.20–0.50 |
| Mg | 0.8–1.3 | 4.0–5.0 | 4.0–5.0 |
| Cr | — | 0.15 | 0.10 |
| Zn | 0.25 | 0.25 | 0.25 |
| Ti | — | 0.10 | 0.10 |

-continued

| | Range or Maximum (%) | | |
|---|---|---|---|
| | AA 3004 | AA 5082 | AA 5182 |
| Other elements (each/total) | 0.05/0.15 | 0.05/0.15 | 0.05/0.15 |
| Al | balance | balance | balance |

It will be understood that all composition percentages above and elsewhere herein are expressed as percentages by weight.

For environmental reasons as well as to conserve materials and energy, used beverage cans are advantageously recycled, i.e. collected as scrap and, after removal of their lacquer or other coatings, melted for recovery and reuse of their metal. In recycling two-alloy cans of the type described above, however, it is not practicable to separate the top ends from the one-piece bodies; hence the recovered metal is a mixture of the end and body alloys, differing in composition from either of those alloys. Attempts to adjust the recovered metal composition, for example, to obtain AA 3004 alloy for making new can bodies, have been uneconomical. U.S. Pat. No. 3,930,395, describing a recovered metal composition (from cans with AA 3004 bodies and AA 5182 ends) that contains 1.8% Mg and 0.8% Mn, proposes adjustment of this composition by addition of manganese or blending with "virgin metal" to produce a 1% Mg, 2–2.5% Mn, alloy for cans. An alloy containing 0.7–1.0% Mn and 1.6–2.0% Mg (with a combined Mn+Mg content of at least about 2.7% ) has been used commercially for farm roofing sheet, but at gauges and with properties not suitable for direct forming of one-piece can bodies. It would be desirable to provide a single alloy composition that could be used for both can ends and one-piece bodies, to facilitate reuse of recovered scrap metal in cans; but none of the aforementioned alloys currently separately employed for ends and bodies have been found satisfactory for such combined use.

It would also be desirable to utilize, e.g. in the manufacture of can body stock, so-called continuous strip casting techniques in place of conventional direct-chill casting of relatively thick ingots. Continuous strip casting is performed by supplying molten metal to a cavity defined between chilled, moving casting surfaces such as parallel runs of a pair of endless belts, thereby to produce a thin (typically less than one inch thick) continuous cast strip. Belt casting apparatus for such casting of strip is described, for example, in U.S. Pat. Nos. 4,061,177 and 4,061,178, the disclosures of which are incorporated herein by this reference. Advantages of continuous strip casting (as compared with direct chill casting of thick ingots) for production of sheet aluminum alloy products include enhanced efficiency and economy, especially in that the thinness of the as-cast strip significantly lessens the extent to which the cast body must be reduced by rolling to a desired sheet gauge, and also in that pre-rolling heat treatment of the as-cast body is simplified or even entirely obviated. Heretofore, however, it has not been feasible to produce sheet for one-piece can bodies from belt-cast strip because AA 3004 alloy rolled from such strip to provide sheet of can body stock gauge at H19 temper does not possess satisfactory properties for commercial drawing and ironing into one-piece can bodies, owing to differences in work-hardening rate, earing, and required annealing temperature between strip-cast and direct chill-cast AA 3004 products.

SUMMARY OF THE INVENTION

An object of the present invention is to provide aluminum alloy can stock, for production of one-piece drawn and ironed can bodies, having a composition that can also be used for the top ends of the cans, thereby to facilitate reuse of metal recovered from recycled cans directly for production of new cans.

Another object is to provide such can stock capable of being produced from continuously cast strip rather than from thick direct-chill-cast ingots.

Further objects are to provide a process for making one-piece drawn-and-ironed can bodies from such stock, and can bodies thus made.

To these and other ends, the present invention broadly contemplates the provision of can body stock comprising cold-rolled aluminum alloy sheet having a composition consisting essentially of the elements set forth below within the following broad limits:

| | Range or Maximum (%) |
|---|---|
| Mn | 0.45–0.8 |
| Mg | 1.5–2.2 |
| Si | 0.1–0.25 |
| Fe | 0.3–1.0 |
| Cu | 0.15 |
| Ti | 0.05 |
| Cr | 0.15 |
| other elements (each/total) | 0.05/0.1 |
| Al | balance |

the combined content of Mn+Mg being not less than about 2.2%, such sheet being directly formable by drawing and ironing, into a one-piece can body, and being at an intemediate temper, with the following properties: ultimate tensile strength, at least about 38 thousand pounds per square inch (k.p,s.i.); yield strength, at least about 35 k.p.s.i.; elongation, at least about 1%; earing, not more than about 4%. Very preferably, earing is not more than about 3%.

As used herein, the term "directly formable" means sheet characterized by a gauge and properties such that it can be cut into blanks and drawn and ironed without any further reduction or thermal treatment. The term "intermediate temper" means the temper of sheet subjected to between about 40% and about 65% cold reduction after conventional batch annealing (and without any subsequent thermal treatment). Such tempers can be achieved, for example, by cold-rolling the sheet to final gauge with an intermediate batch anneal performed at a gauge such that the extent of cold reduction from the annealing gauge to the final (can body stock) gauge is within the stated 40–65% range.

Comparable mechanical properties in the cold-rolled sheet can also be attained, when the inter-anneal during cold working is a flash anneal (as distinguished from a conventional batch anneal) with subsequent cold working of about 30% to about 65%, and the term intermediate temper will broadly be understood to embrace flash-annealed sheet having the latter levels of subsequent cold reduction.

The process of the invention broadly comprises the steps of providing can body stock as defined above, and directly forming one-piece can bodies therefrom by drawing and ironing. The can body of the invention is the one-piece (integral bottom end and generally cylindrical side wall) product of this process.

It is found that aluminum alloys having compositions within the above-stated broad limits, when processed into sheet having the specified gauge, temper, and properties, can be drawn and ironed to produce one-piece can bodies having satisfactory strength and other properties, notwithstanding that the intermediate temper of the can body stock is lower than the H19 temper required for AA 3004 can body stock. Further, it is found that the same alloy composition (through, preferably, processed into cold-rolled sheet at H19 temper) can be used to make can top ends, so that the scrap metal recovered from used cans is directly reusable to make new cans, i.e. without adjustment of composition.

It is additionally found that such can body stock, directly formable into one-piece drawn-and-ironed can bodies, can be made from continuously cast strip as well as from direct-chill-cast ingot, thereby enabling realization of the advantages of continuous strip casting in the production of can body stock. This beneficial result is attributable both to the composition of the alloy and to the processing features which provide the stock in intermediate rather than the conventional extra-hard (H19) temper. In particular, the can body stock of the present invention exhibits a decreased level of 45° earing as compared with AA 3004 sheet of like gauge at H19 temper produced from continuously cast strip, yet provides cans of acceptable strength. Also, the annealing temperature required for the present can body stock is advantageously lower than that required for continuously strip-cast AA 3004 alloy, so that problems of staining and oxidation, associated with the higher annealing temperatures, are avoided.

It is at present believed that these advantages are explained by the following considerations:

Continuously cast strip of AA 3004 alloy, as compared with direct-chill-cast ingot of the same alloy, exhibits a greater retention of manganese in solid solution and thus leads to a greater degree of unfavourable crystallographic orientation (texture) in the annealed sheet. The supersaturation effect also increases the annealing temperature required. The reduced manganese content of the present alloy (as compared to AA 3004) enables annealing to be performed at a lower temperature, and together with the provision of the final can stock at an intermediate temper satisfactorily decreases the extent of 45° earing, as compared with AA 3004-H19 stock produced from continuously cast strip, while the increase in magnesium content in the present alloy (compared with AA 3004) adequately compensates for the loss of strength that would otherwise accompany reduction in manganese.

Still another advantage of the present can stock is that its composition limits embrace scrap compositions obtained, for example, by melting conventional cans having AA 3004 bodies and AA 5082 or 5182 ends; hence, by processing such scrap compositions to obtain sheet having the temper and other properties specified by the present invention, currently available scrap can be used without significant compositional adjustment to make new can bodies.

Two specific examples of alloy compositions suitable for the practice of the invention, falling within the broad limits stated above, and herein respectively designated Alloy A and Alloy B, consist essentially of the following:

| | Alloy A | | Alloy B | |
|---|---|---|---|---|
| | Range or Maximum (%) | Nominal (%) | Range or Maximum (%) | Nominal (%) |
| Mn | 0.60–0.80 | 0.70 | 0.45–0.55 | 0.50 |
| Mg | 1.70–1.90 | 1.80 | 1.80–2.00 | 1.90 |
| Si | 0.10–0.20 | 0.15 | 0.10–0.20 | 0.15 |
| Fe | 0.40–0.60 | 0.50 | 0.40–0.60 | 0.50 |
| Cu | 0.06–0.10 | 0.08 | 0.06–0.10 | 0.08 |
| Ti | 0.05 | | 0.05 | |
| Cr | — | | 0.05–0.15 | 0.10 |
| other elements (each/total) | 0.03/0.10 | | 0.03/0.10 | |
| Al | balance | | balance | |

Further features and advantages of the invention will be apparent from the detailed description hereinbelow set forth.

DETAILED DESCRIPTION

Especially for production of can body stock from continuously cast strip, a preferred alloy composition in accordance with the invention consists essentially of 0.5–0.8% Mn, 1.5–2.2% Mg, 0.1–0.25% Si, 0.3–1.0% Fe, up to 0.15% Cu, 0.015–0.025% Ti, other elements less than 0.05% each, balance Al; with a combined content of Mn and Mg of not less than about 2.2%; and a presently especially preferred composition consists essentially of the following:

| | Range or Maximum (%) | Nominal (%) |
|---|---|---|
| Mn | 0.65–0.75 | 0.70 |
| Mg | 1.70–1.90 | 1.80 |
| Si | 0.12–0.18 | 0.15 |
| Fe | 0.45–0.60 | 0.50 |
| Cu | 0.06–0.10 | 0.08 |
| Ti | 0.015–0.025 | 0.020 |
| other elements (total) | 0.10 | |
| Al | balance | |

Stated with reference to the foregoing especially preferred composition, the content of copper is limited to decrease its detrimental effect on corrosion resistance, but some copper is included because of its beneficial effects in refining recrystallized grain size and providing a useful increment of strength upon work hardening.

Further in accordance with presently preferred practice, to produce can body stock embodying the invention, an alloy having a composition as just described is continuously cast into strip, e.g. having a thickness between about ½ and about ¾ inch, in a belt caster of the type described in the aforementioned U.S. Pat. No. 4,061,177 and No. 4,061,178 (to which reference may be made for a detailed description of the caster structure and operation), using steel casting belts with shot-blasted surfaces to which a parting layer is applied such that a heat flux of at least 40 calories/cm.$^2$/second through the belts is provided. By way of example, half-inch-thick strip is typically cast at a speed of 30–35 ft./minute and fed directly from the caster into a hot rolling mill at an ingoing temperature of between 380° and 450° C.; it is typically subjected to a total hot reduction of about 72 to about 82%, leaving the hot mill at an exit temperature of about 150°–200° C., and is then coiled.

Thereafter, the hot-rolled coil (herein termed "reroll") is cold rolled to a final can body stock gauge, e.g. a final gauge of 0.013–0.015 inch, with an anneal performed at a gauge such that the amount of cold reduction after annealing (i.e. to reduce the coil from the annealing gauge to the final can body stock gauge) is between 40 and 65% using a batch anneal or 30–65% using a flash-anneal, thereby to provide can body stock at an intermediate temper. In a typical example of half-inch cast strip hot-rolled to a gauge of 0.090 inch, the reroll is reduced from the latter gauge to 0.040 inch in an initial cold-rolling operation, then batch annealed for two hours at 400°–420° C., and then further cold rolled to a final gauge of 0.015 inch.

The can body stock thus produced is cut into suitable blanks and formed directly, by drawing and ironing, into one-piece can bodies. Properties of the can body stock, i.e. in final cold-rolled gauge, include an ultimate tensile strength of at least about 38 k.p.s.i. (but not more than about 45 k.p.s.i.), yield strength of at least about 35 k.p.s.i. (but not more than about 44 k.p.s.i.), at least about 1% elongation, and not more than about 3% earing. The attainment of can body stock, produced from continuously cast strip (and thereby achieving the economic benefits of that casting procedure), having acceptable properties for drawing and ironing into one-piece can bodies, is at present believed attributable in particular to the fact that the alloy composition has a high Mg content and a low Mn content as compared to AA 3004 and that the can stock at final gauge is at an intermediate temper rather than at H19 temper as is conventional for AA 3004 can body stock.

Alternatively, can body stock in accordance with the invention can be produced from conventionally direct-chill-cast thick ingot. Using, for example, an alloy composition such as alloy A or alloy B above, a thick direct-chill ingot is cast, scalped, homogenized (or re-heated) and hot-rolled e.g. to a reroll gauge of about 0.100 inch, all by procedurally conventional operations. Thereafter, the reroll is cold rolled to final can body stock gauge with an intermediate anneal performed at a gauge selected such that the amount of cold reduction after anneal (down to the final can body stock gauge) is about 40 to about 65% for batch-annealed material or about 30 to about 65% for flash-annealed material, to provide the can body stock at an intermediate temper, again having properties as set forth above, and directly formable into drawn-and-ironed one-piece can bodies.

By way of further illustration of the invention, reference may be made to the following specific examples:

EXAMPLE I

Three alloys were prepared, respectively having the following percentage contents of alloying elements (balance essentially aluminum):

| | Alloy 1 | Alloy 2 | Alloy 3 |
|---|---|---|---|
| Mn | 0.64 | 0.53 | 0.52 |
| Mg | 1.65 | 2.45 | 1.87 |
| Si | 0.15 | 0.16 | 0.15 |
| Fe | 0.42 | 0.45 | 0.39 |
| Cu | 0.08 | 0.07 | 0.08 |
| Ti | 0.01 | 0.02 | 0.01 |
| Cr | — | — | 0.06 |

Alloys 1 and 3 were respectively examples of the alloys designated A and B above.

Several ingots of each of these alloys, each 18"×56½"×165", were cast in a conventional direct-chill-casting operation. The ingots were scalped one inch on each side, homogenized (or reheated), hot-rolled to produce coil at a gauge of about 0.100 inch, and cold-rolled to a final gauge of about 0.0135 inch, with or without a batch anneal before cold rolling; during cold rolling each coil was batch interannealed at a gauge such that the cold reduction to final gauge after the anneal was about 50%. Processing conditions, and mechanical properties of the 0.0135 inch cold rolled sheet, were as follows:

| Alloy | Coil | Processing Conditions* | Ultimate Tensile Strength (k.p.s.i) | Yield Strength (k.p.s.i.) | Elongation (%) | 45° Earing (%) |
|---|---|---|---|---|---|---|
| 1 | i | HA | 39.0 | 36.0 | 3.1 | 2.8 |
| | ii | HX | 38.6 | 35.2 | 3.5 | 2.2 |
| | iii | RA | 38.9 | 36.0 | 3.2 | 2.4 |
| 2 | iv | RA | 45.1 | 40.6 | 4.1 | 1.8 |
| | v | HA | 45.4 | 40.2 | 4.8 | 2.6 |
| | vi | HX | 45.2 | 39.8 | 5.3 | 3.0 |
| 3 | vii | HA | 40.2 | 37.3 | 3.2 | 2.8 |

*H - ingot homogenized
R - ingot reheated
A - anneal before cold rolling
X - no anneal before cold rolling Samples of each coil were then formed into one-piece can bodies by drawing and ironing on equipment previously employed to produce such bodies from conventional AA 3004-H19 can body stock. Metal of all the coils ironed with no sidewall scoring or die buildup problems. Satisfactory can bodies were produced with the coils of alloys 1 and 3, although some long cans and jamming in the trimmer and unloader (owing to long shell ears) were observed, and in the case of alloy 1, some folding or wrinkling of can tops occurred, and in the case of coil i, some split cans were produced. Alloy 2 coils v and vi produced split cans, attributed to an excessively high rate of work hardening, and alloy 2 coil iv cans caused excessive jam-ups in the trimmer.

EXAMPLE II

Two further alloys were prepared respectively having the following percentage contents of alloying elements (balance essentially aluminum):

| | Alloy 4 | Alloy 5 |
|---|---|---|
| Mn | 1.20 | 0.66 |
| Mg | 0.99 | 1.60 |
| Si | 0.17 | 0.13 |
| Fe | 0.53 | 0.51 |
| Cu | 0.07 | 0.09 |
| Ti | 0.010 | 0.012 |

Alloy 4 was an AA 3004 type alloy, and alloy 5 had a composition in accordance with the present invention.

Each alloy was continuously cast as ½-inch-thick strip on a belt caster of the type referred to above, and rolled to can body stock gauge. One coil of each alloy was homogenized for 8 hours at 575° C. (at 0.090 inch gauge for alloy 4 and at 0.060 inch gauge for alloy 5) while another coil of each alloy was simply annealed for 2 hours at 470° C. (alloy 4) or 440° C. (alloy 5).

Pertinent treatments and properties of the coils of can body stock gauge sheet thus produced are as follows:

| Alloy | Heat Treatment* | Final Cold Work (%) | Longitudinal Tensile Properties: Ult. Tensile Strength (k.p.s.i.) | Yield Strength (k.p.s.i.) | Elongation (%) | 45° Earing (%) | Buckle Pressure** (p.s.i.) |
|---|---|---|---|---|---|---|---|
| 4 | A | 63 | 41.0 | 39.4 | 2.3 | 3.5 | 92 |
| | H | 83 | 42.7 | 41.9 | 1.8 | 3.7 | 96 |
| 5 | A | 50 | 39.5 | 36.1 | 4.0 | 1.5 | 92 |
| | H | 75 | 41.3 | 39.9 | 2.8 | 3.9 | 94 |

*A - annealed
H - homogenized
**adjusted for gauge

About 60 one-piece can bodies were formed, by drawing and ironing, from each coil, with no scoring problems. The coil of alloy 5 with 50% reduction after annealing, demonstrated preferred properties, although its yield strength was below that typically shown by conventional can stock materials, the buckle pressure satisfactorily exceeded the minimum standard of 90 p.s.i. generally required by can manufacturers.

The remaining three coils exhibited unduly high earing in the drawing-and-ironing operation, as would be expected from the earing levels recorded above.

The batch annealing temperature of 470° C. required by Alloy 4 led to unacceptably high levels of oxidation and staining and the problem cannot be avoided by flash-annealing at economically acceptable rates.

Although the annealing temperature of 440° C. applied to Alloy 5 leads to barely acceptable levels of oxidation and staining, it has been found possible to lower the annealing temperature for Alloy 5 to 410°-420° C., at which the staining and oxidation is greatly reduced without adverse effects on the earing characteristics. Large scale trials have been carried out successfully on sheet of a composition similar to Alloy 5 (but having a Mg content of 1.8%) and annealed at 410°-420° C.

It is to be understood that the invention is not limited to the features and embodiments hereinabove specifically set forth, but may be carried out in other ways without departure from its spirit.

We claim:

1. Can stock comprising cold-rolled sheet of an aluminum alloy consisting essentially of 0.45-0.8% Mn, 1.5-2.2% Mg, 0.1-0.25% Si, 0.3-1.0% Fe, up to 0.15% Cu, up to 0.05% Ti, up to 0.15% Cr, other elements up to 0.05% each and up to 0.1% total, balance Al, the combined content of Mn+Mg being not less than about 2.2% said sheet being directly formable by drawing and ironing, into a one-piece can body, and being at an intermediate temper, with the following properties: ultimate tensile strength, at least about 38 k.p.s.i.; yield strength, at least about 35 k.p.s.i.; elongation, at least about 1%; earing, not more than about 4%.

2. Can stock as defined in claim 1, wherein said alloy consists essentially of 0.5–0.8% Mn, 1.5–2.2% Mg, 0.1–0.25% Si, 0.3–1.0% Fe, up to 0.15% Cu, 0.015–0.025% Ti, other elements up to 0.05% each and up to 0.1% total, balance Al, the combined content of Mn+Mg being not less than about 2.2%.

3. Can stock as defined in claim 2, wherein said alloy consists essentially of 0.60–0.80% Mn, 1.70–1.90% Mg, 0.10–0.20% Si, 0.40–0.60% Fe, 0.06–0.10% Cu, up to 0.05% Ti, other elements up to 0.03% each and up to 0.10% total, balance Al.

4. Can stock as defined in claim 3, wherein said alloy consists essentially of about 0.70% Mn, about 1.80% Mg, about 0.15% Si, about 0.50% Fe, about 0.08% Cu, up to 0.05% ti, other elements up to 0.03% each and up to 0.10% total, balance Al.

5. Can stock as defined in claim 1, wherein said alloy consists essentially of 0.45–0.55% Mn, 1.80–2.00% Mg, 0.10–0.20% Si, 0.40–0.60% Fe, 0.06–0.10% Cu, up to 0.05% ti, 0.05–0.15% Cr, other elements up to 0.03% each and up to 0.10% total, balance Al.

6. A process for making a can body comprising (a) providing, at an intermediate temper, a cold-rolled can body blank of sheet aluminum alloy consisting essentially of 0.45–0.8% Mn, 1.5–2.2% Mg, 0.1–0.25% Si, 0.3–1.0% Fe, up to 0.15% Cu, up to 0.05% Ti, up to 0.15% Cr, other elements up to 0.05% each and up to 0.1% total, balance Al, the combined content of Mn+Mg being not less than about 2.2%, said sheet having the following properties: ultimate tensile strength, at least about 38 k.p.s.i.; yield strength, at least about 35 k.p.s.i.; elongation, at least about 1%; earing, not more than about 4%; and (b) directly forming said blank into a one-piece can body by drawing and ironing.

7. A one-piece can body, produced by the process of claim 6.

* * * * *

UNITED STATES PATENT AND TRADEMARK OFFICE

CERTIFICATE OF CORRECTION

PATENT NO. : 4,318,755

DATED : March 9, 1982

INVENTOR(S) : Jeffrey et al.

It is certified that error appears in the above-identified patent and that said Letters Patent are hereby corrected as shown below:

Col. 3, line 38, "intemediate" should read --intermediate-- .

Col. 4, line 11, "through" should read --though-- .

Col. 7, lines 15 - 32, in the table, the headings are incorrectly broken up; hence, delete the space between lines 17 and 31 to join the words in the headings at lines 15 - 16 with the words in the headings at line 32.

Col. 9, line 19, and col. 10, line 2, "ti" should read --Ti-- .

Signed and Sealed this

*Twenty-fifth* Day of *January 1983*

[SEAL]

*Attest:*

GERALD J. MOSSINGHOFF

*Attesting Officer*

*Commissioner of Patents and Trademarks*